US005144697A

United States Patent [19]

Sandbeck

[11] Patent Number: 5,144,697

[45] Date of Patent: Sep. 8, 1992

[54] BI-WAISTED TROUSERS

[76] Inventor: Rick L. Sandbeck, 15 Glacier La., Omro, Wis. 54963

[21] Appl. No.: 711,890

[22] Filed: Jun. 7, 1991

[51] Int. Cl.[5] ..... A41D 1/06

[52] U.S. Cl. ..... 2/236; 2/219; 2/220; 2/221; 2/235; 2/237; 2/227; 2/79

[58] Field of Search ..... 2/236, 219, 220, 221, 2/235, 237, 227, 79

[56] References Cited

U.S. PATENT DOCUMENTS

| | | | |
|---|---|---|---|
| Re. 6,280 | 2/1875 | Eager | 2/237 |
| 127,750 | 6/1872 | Eager | 2/237 |
| 143,792 | 10/1873 | Taylor | 2/237 |
| 360,979 | 4/1887 | White | 2/237 |
| 518,369 | 4/1894 | Leavitt | 2/237 |
| 620,435 | 2/1899 | Fisher | 2/227 |
| 987,412 | 3/1911 | Stern | 2/237 |
| 2,581,627 | 1/1952 | Bubb | 2/237 |
| 4,004,297 | 1/1977 | Polack | 2/227 |
| 4,249,267 | 2/1981 | Voss | 2/227 |
| 4,669,130 | 6/1987 | Brown | 2/227 |

*Primary Examiner*—Werner H. Schroeder
*Assistant Examiner*—Gloria Hale
*Attorney, Agent, or Firm*—Donald Cayan

[57] ABSTRACT

Bi-waisted trousers conform to and comfortably grip the hips of a stout person without requiring a belt or hitching by the person. The bi-waisted trousers have front and back panels with respective waistbands located such that the front waistband is parallel to and approximately 2.5 inches lower around the hips than the back waistband. An elastic dart is placed on the opposite sides of the trousers between the front and back panels. An adjustable strap may be placed across one or both darts.

3 Claims, 1 Drawing Sheet

BI-WAISTED TROUSERS

BACKGROUND OF THE INVENTION

1. Field of the Invention This invention pertains to wearing apparel, and more particularly to pants and trousers.

2. Description of the Prior Art Numerous designs of clothing have been developed over the years. Styles and materials are constantly changing in response to comfort and fashion requirements.

An aspect of clothing design that has been overlooked in the past concerns trousers that are suitable for stout persons. Prior trousers invariably are held in place by suspenders, belts, or elastic waistbands. However, many men find suspenders uncomfortable. Trousers with elastic waistbands are also usually unacceptable for two reasons. First, for the elastic waistband to be effective, it must lie above the hips. However, the lower abdominal region of a stout person is about in line with the hips, such that the front of the trousers waistband tends to slide down along the lower abdomen. To keep the trousers in place, the wearer is obliged to frequently hitch them back to their proper place. That practice is widespread and unsatisfactory. The second reason trousers with elastic waistbands are not widely worn is that few practical types of trousers suitable for ordinary wear are available with elastic waistbands.

Most stout persons are forced to rely on belts to keep the trousers in place. Unfortunately, using a belt entails the same problems as using an elastic waistband, because trousers with a belt also tend to slide down the lower abdominal region. When that happens, the belt becomes slack even if the belt initially remains in place around the back. Eventually the entire belt slips below the waist line. As a result, the stout person wearing a belt must frequently hitch his trousers back up to their proper place.

Another drawback of prior trousers as worn by stout persons is that the trousers do not fit well around the buttocks. The trousers tend to bag in the back, and the bagginess is especially pronounced when the trousers slip below the waist line during wear.

Thus, a need exists for improvements in trousers design.

SUMMARY OF THE INVENTION

In accordance with the present invention, comfortable bi-waisted trousers are provided that eliminate the need for stout persons to hitch their trousers during wear. This is accomplished by designing the trousers with a front waistband that is at a lower level than the back waistband.

The bi-waisted trousers have two legs and a back section that may be of any design and style. The back section may have hip pockets, as are well known. The back section terminates in the back waistband, which lies just above the hips when the trousers are worn in normal fashion.

The trousers legs also blend into a front section, the sides of which are directly joined to the corresponding sides of the back section in the regions of the upper thighs. The front section may be of any style, with a conventional zipper and pockets. The front section terminates in a front waistband that is below the level of the hips when the trousers are worn.

Between the adjoining sides of the front and back sections are inserted darts of stretchable material. The top edge of each dart joins the top edges of the front and back waistbands. If desired, a fastener, such as a strap of hook and eye tape, may be used to connect the front and back sections across each of the elastic darts.

The bi-waisted trousers of the present invention enable a stout person to dispense with suspenders, elastic waistbands, and belts while eliminating bagginess in the back and the need to constantly hitch the trousers to keep them in place The back waistband of the trousers hugs the wearer above his hips. The front waistband hugs the wearer at the lowermost region of the lower abdomen, where the tendency of the front waistband to slide downwardly is minimal. Consequently, the bi-waisted trousers are both attractive and comfortable, and they enable a person to wear them with confidence and inattention.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
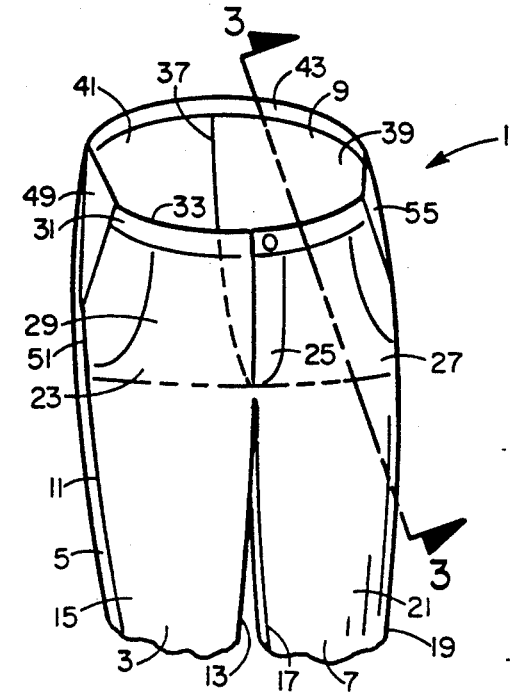
FIG. 1 is a perspective view of the bi-waisted trousers of the present invention.
Figure 2:
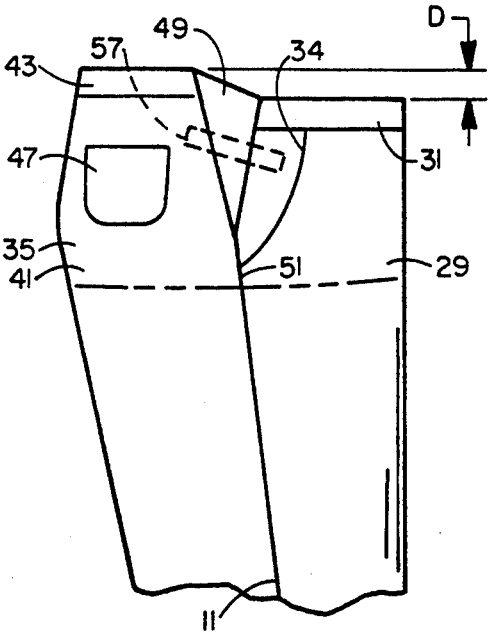
FIG. 2 is a side view of the bi-waisted trousers of the present invention.
Figure 3:
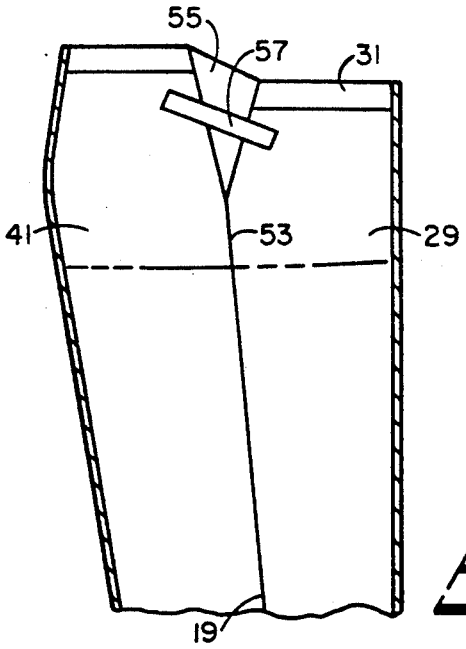
FIG. 3 is a cross sectional view taken along lines 3—3 of FIG. 1, but with the pockets removed for clarity.

Referring to FIGS. 1–3, a bi-waisted trousers 1 is illustrated that includes the present invention. The bi-waisted trousers are particularly appropriate for wearing by stout men, but it will be understood that the invention may be worn by other persons as well.

The bi-waisted trousers 1 are made from four primary pieces of material: a right front piece 3, a right back piece 5, a left front piece 7, and a left back piece 9. The lower portions of the right front and right back pieces 3 and 5, respectively, are cut and sewn along longitudinally extending seams 11 and 13 to form a right leg 15. Similarly, the lower portions of the left front piece 7 and left back piece 9 are cut and sewn together along seams 17 and 19 to form a left leg 21.

The upper portion 23 of the right front piece 3 is joined by a conventional zipper 25 to the upper portion 27 of the left front piece 7 to create a front panel 29. The front panel 29 terminates in a front waistband 31. Pockets 34 may be sewn into the front panel 29, as is known. In a similar manner, the upper portion 35 of the right back piece 5 is sewn along seam 37 to the upper portion 39 of the left back piece 9 to create a back panel 41. The back panel 41 has a waistband 43. The back panel may have one or two conventional pockets 47.

In accordance with the present invention, the front and back waistbands 31 and 43, respectively, of the bi-waisted trousers 1 are vertically offset from each other. The back waistband 43 is located in generally the same location relative to the legs 15 and 21 and to the hips of a wearer as in conventional trousers. That is, the back waistband lies generally a short distance above the wearer's hips. The front waistband 31 lies at a level lower than the back waistband by an offset distance D. I have found that an offset distance of approximately 2.5 inches works very well for most stout persons. In some cases, an offset distance D of approximately three inches provides better performance.

Further in accordance with the present invention, the front and back panels 29 and 41, respectively, are not joined directly to each other for the full distance between the waistbands 31, 43 and the legs 15, 21. Rather, the seam 11 along the right leg 15 continues only a short distance, as shown at reference numeral 51, between the right side of the front and back panels. The seam 19 also continues, as shown at reference numeral 53, for only a short distance between the left side of the front and back panels adjacent the left leg 21. A first triangular dart 49 is interposed between the waistband, the short seam 51, and the front and back panels on the right side of the bi-waisted trousers 1. A similar dart 55 is sewn between the waistband, the short seam 53, and the front and back panels on the left side of the bi-waisted trousers. Both darts 49 and 55 are made of an elastic material, such as that sold under the trademark Spandex.

If desired, a fastener, such as an adjustable strap 57, may be attached to the front and back panels 29 and 41, respectively, across one or both darts 49 and 55. Although the strap 57 may be of any suitable type, I prefer a hook and eye tape arrangement such as that marketed under the trademark Velcro. By properly adjusting the strap, excessive stretch of the darts during wear is avoided.

The bi-waisted trousers 1 are exceptionally comfortable to wear by stout persons. The straps 57 enable the person to adjust the waist size to generally suit his particular measurements. The elastic darts 49 and 55 cooperate with the back waistband 43 to snugly and comfortably grip his waist over the hips around his back. The darts also cooperate with the front waistband 31 to snugly but comfortably grip his lower abdominal region. The result is that the need for the person to constantly hitch his trousers to keep them in place is eliminated. Further, the bi-waisted trousers properly fit the person's buttocks and do not have the baggy look there of prior trousers.

Thus, it is apparent that there has been provided, in accordance with the invention, bi-waisted trousers that fully satisfy the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An article of clothing worn around a person's legs and hips comprising:

a. a front section of material having two front leg portions, a front panel, and a front waistband that lies generally in a first plane; and b. a back section of material having two back leg portions, a back panel, and a back waistband that lies generally in a second plane generally parallel to and offset from the first plane, the front and back leg portions being joined to each other to enclose the person's legs, the front and back panels being joined to each other to enclose the person's hips, the front waistband being located and worn around the person at a level closer to the legs than the back waistband.

2. The article of clothing of claim 1 wherein the offset between the first and second planes of the front and back waistbands, respectively, is approximately 2.5 inches.

3. The article of clothing of claim 1 wherein:

a. the article of clothing defines a longitudinal axis that is generally aligned with a vertical axis through the person's legs and hips when the person wears the article of clothing; and b. the first and second planes of the front and back waistbands, respectively, are generally perpendicular to the longitudinal axis of the article of clothing.

* * * * *